United States Patent [19]

Haufe et al.

[11] 4,011,145

[45] Mar. 8, 1977

[54] ELECTROCHEMICAL MANUFACTURE OF AROMATIC ESTERS

[75] Inventors: Juergen Haufe, Ludwigshafen; Costin Rentzea, Heidelberg; Dieter Degner, Ludwigshafen, all of Germany

[73] Assignee: BASF Aktiengesellschaft, Ludwigshafen (Rhine), Germany

[22] Filed: June 18, 1975

[21] Appl. No.: 587,919

[30] Foreign Application Priority Data

July 19, 1974 Germany ..... 2434845

[52] U.S. Cl. ..... 204/59 R; 204/72

[51] Int. Cl.[2] ..... C25B 3/00

[58] Field of Search ..... 204/59 R, 72

[56] References Cited

UNITED STATES PATENTS 3,652,430 3/1972 Beck et al. ..... 204/72

FOREIGN PATENTS OR APPLICATIONS 1,021,908 3/1966 United Kingdom ..... 204/59 R

*Primary Examiner*—F.C. Edmundson

*Attorney, Agent, or Firm*—Johnston, Keil, Thompson & Shurtleff

[57] ABSTRACT

Electrochemical manufacture of aromatic esters of the naphthalene series by acylation of naphthalene derivatives in an alkanoic acid, wherein the electrolysis is carried out in the presence of a conducing salt of the formula $$[R^1R^2R^3NH]^+ [OOCR^4]^-$$

in which $R^1$, $R^2$ and $R^3$ denote hydrogen and/or alkyl and $R^4$ denotes hydrogen or alkyl of from 1 to 6 carbon atoms.

4 Claims, No Drawings

ELECTROCHEMICAL MANUFACTURE OF AROMATIC ESTERS

This invention relates to a novel electrochemical process for the manufacture of aromatic esters.

The electrochemical manufacture of aromatic esters by anodic acyloxylation of aromatics is known, for example, from U.K. Pat. No. 1,021,908. When this process is carried out on an industrial scale, the relatively large amounts of conducting salts necessary, for example sodium acetate or potassium acetate, hamper the isolation of the products and the recovery of unreacted reactants, since complicated and expensive separating operations must be carried out.

We have now found that the electrochemical manufacture of aromatic or heterocyclic esters by anodic acyloxylation of aromatic or heterocyclic compounds with an alkanoic acid may be carried out in a far more advantageous manner if the electrolysis is carried out in the presence of a conducting salt of the formula $$[R^1R^2R_3NH]^+ [OOCR^4]^-$$

in which $R^1$, $R^2$ and $R^3$ denote hydrogen and/or alkyl and $R^4$ denotes hydrogen or alkyl of from 1 to 6 carbon atoms.

Suitable aromatics for the process of the invention are mono- and poly-nuclear compounds such as benzene derivatives, naphthalenes, anthracenes, phenanthrenes, acenaphthenes, acenaphthylenes, tetracenes, perylenes and chrysenses. Examples of suitable benzene derivatives are those having one or more alkyl groups. In addition, benzene derivatives may be acyloxylated which contain one or more aryl, alkoxy, aryloxy, halogen, acyloxy or acylamino groups. Benzene derivatives containing alkyl groups are for example toluene, xylenes, ethylbenzenes, trimethylbenzenes, durene, pentamethylbenzene and hexamethylbenzene; benzene derivatives containing branched alkyl groups are for example isopropylbenzenes; benzene derivatives containing aryl groups are for example biphenyls; benzene derivatives containing alkoxy and aryloxy groups are for example methoxy, ethoxy and propoxy benzenes; benzene derivatives containing halogen atoms are for example chlorobenzene and benzene derivatives containing acyloxy or acylamino groups are for example monoacetoxy toluene or acetanilide.

Examples of polynuclear aromatics are naphthalene and naphthalene derivatives, which may carry alkyl, alkoxy, acyloxy, acylamino, halogen, cyano, nitro and sulfonate groups, and other examples are carbocyclic compounds containing for example 5-rings such as indans or indenes. Specific examples of suitable compounds are naphthalene, 1- and 2-methylnaphthalenes, 1-chloronaphthalene, 1-nitronaphthalene, naphthyl acetate, 1-acetoxy-2-methylnaphthalene and 1-acetoxy-3-methylnaphthalene. Also suitable for use in the acyloxylation of the invention are heterocyclic compounds such as quinolenes and benzofurans.

In our novel process we prefer to manufacture esters of the general formula

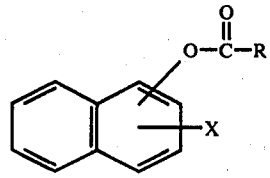

I in which X denotes hydrogen, chlorine or methyl and R denotes hydrogen, methyl or ethyl, by anodic acyloxylation of compounds of the formula

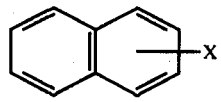

II, with an acid of the formula RCOOH and in the presence of said conducting salts. The acyl group preferentially occurs in the $\alpha$-position of the naphthalene. The main products thus obtained are 1-acyloxynaphthalenes or, where the 1-position is already substituted, the 4-acyloxynaphthalenes.

The alkanoic acids used for acyloxylation and which also serve as solvents for the aromatic or heterocyclic compounds to be reacted are preferably alkanoic acids of from 1 to 6 carbon atoms in which the alkyl radicals may or may not be branched. As examples, mention may be made of formic acid, acetic acid, propionic acid, butyric acid, valeric acid, isovaleric acid and caproic acid. The use of formic, acetic and propionic acids is of special industrial interest.

The conducting salts of the formula $$[R^1R^2R^3NH]^+ [OOC\text{-}R^4]^-$$

contain, as $R^1$, $R^2$ and $R^3$, hydrogen atoms and/or alkyl groups. The alkyl groups may be straight-chain or branched-chain and advantageously contain from 1 to 8 carbon atoms. Suitable examples thereof are methyl, ethyl, n-propyl, isopropyl, n-butyl, isobutyl, n-hexyl and n-octyl groups. $R^4$ denotes hydrogen or straight-chain or branched-chain alkyl of from 1 to 6 carbon atoms such as methyl, ethyl, n-propyl, isopropyl, n-butyl and isobutyl.

Examples of compounds of the above kind are trimethylammonium formate, trimethylammonium acetate, trimethylammonium propionate, triethylammonium formate, triethylammonium acetate, triethylammonium propionate, tri-n-butylammonium acetate, dimethylammonium formate, diethylammonium formate, dimethylammonium acetate, diethylammonium acetate and dimethylammonium propionate.

These compounds may be prepared in a simple manner by adding amine (introduction of gaseous amines) of the formula $$R^1R^2R^3N$$

to excess alkanoic acid of the formula $$R^4COOH.$$

The great advantage of the process of the invention over the prior art lies in the surprising fact that, following electrolysis, the reaction mixture may be worked up by simple distillation. The conducting salts of the above formula in which $R^1$, $R^2$ and $R^3$ denote alkyl may be readily separated by distillation and recycled for further use. The conducting salts of the above formula in which $R^1$ and/or $R^2$ and/or $R^3$ denote hydrogen may be readily separated by distillation but cannot be recovered in an unchanged form, since water elimination occurring during distillation causes them to be converted to the corresponding carboxamides. For example, if $R^3$ is hydrogen, the reaction may be represented as follows:

$$R^1R^2NH_2^+\ OOC-R^4 \xrightarrow[-H_2O]{\Delta} R^1R^2N-CO-R^4.$$

The anodic acyloxylation of the invention is preferably carried out in undivided cells. However, divided cells may also be used if, for example, the starting materials or the product of the reaction might be cathodically reduced under the conditions of the reaction. Where undivided cells are used, it is preferred to employ those having small electrode gaps, for example gaps of from 0.25 to 2 mm, to minimize the cell potential. The anodes are preferably of graphite or $PbO_2$ or are $PbO_2$-coated electrodes, or are made of noble metals such as platinum or gold. Suitable cathodes are graphite, iron, steel or lead electrodes. The electrolyte is a solution of the aromatic or heterocyclic compound in the alkanoic acid, to which the distillable conducting salt has been added in the amount necessary to give an adequate conductivity. Concentration of the aromatic compound is limited by its solubility in the mixture of alkanoic acid and conducting salt.

The electrolyte may have the following composition: from 5 to 60% by weight of aromatic or heterocyclic compound, from 5 to 70% by weight of alkanoic acid, from 1 to 20% by weight of conducting salt and from 0 to 50% by weight of cosolvent.

In the case of naphthalene or 2-methylnaphthalene, the electrolyte contains, for example, from 5 to 45% by weight of aromatic compound. To achieve high space-time yields, it is preferred to carry out the reaction at high depolarizer concentrations (>> 20% by weight). The concentration of conducting salt is advantageously selected such that the conductivity achieved is sufficient for the use of high current densities without the expense of distillation being unduly increased. For example, in the anodic acyloxylation of napthalene or 2-methylnaphthalene, use is made of 1 to 15% by weight solutions of conducting salt, preferably 1 to 8% by weight solutions.

The solvents used in the electrochemical acyloxylation are the appropriate alkanoic acids, for example formic acid in the case of formoxylations and acetic in the case of acetoxylations. To increase the solubility of the aromatic compounds in the basic electrolyte, it is possible to use cosolvents which ae stable under the conditions of the process and are electro-inactive and which cause no undue reduction in the conductivity of the electrolyte, for example acetonitrile, acetone, dimethoxyethane and methylene chloride.

The composition of the product of the anodic acyloxylation essentially depends on the degree of conversion, i.e. on the charge Q which passes through the electrolyte per mole of aromatic compound. Monoacyloxylated products are preferentially formed when the electrolysis is carried out at a charge rate Q of from 0.4 to 1.5 F/mole of aromatic compound, and products showing a higher degree of acyloxylation are preferentially obtained with Q is greater than 2 F/mole of aromatic compound. For example, in the anodic acyloxylation of 2-methylnaphthalene to monoacyloxy-2-methylnaphthalene and in the acyloxylation of naphthalene to monoacyloxynaphthalene, electrolysis is carried out at from 1.0 to 1.5 F/mole of aromatic compound. The current densities may be varied within wide limits, for example from 0.1 to 30 A/dm². For example, in the anodic acyloxylation of naphthalene or 2-methylnaphthalene, current densities of from 10 to 25 A/dm² are used. The temperature of the electrolyte during electrolysis is restricted by the boiling point of the alkanoic acid or of any cosolvent used. For example, in the case of the anodic acetoxylation 2-methylnaphthalene or naphthalene, the temperature may be from 20° to 70° C.

The reaction mixture obtained from the electrolysis is preferably worked up by distillation, during which process the alkanoic acid, the distillable conducting salt or the corresponding carboxamide and — if used — the cosolvent are distilled off. If residues of unreacted aromatic compound are present, these may be separated from the aromatic esters by fractional distillation, extraction or recrystallization. The aromatic esters may, if necessary, be further purified by distillation or recrystallization. The alkanoic acid, unchanged distillable conducting salt and, if present, unreacted aromatic compounds may be recycled.

The process of the invention may be carried out either continuously or batchwise. If an increase in potential should occur during electrolysis, this may be counteracted by short-circuiting the cell for a brief period or by reversing the poles of the electrodes.

The aromatic esters obtained as products of our novel process are intermediates in the preparation of antioxidants or additives for lubricants. 1-naphthylacetate may be converted in known manner to α-naphthol, which is required as intermediate for the insecticide carbaryl. 2-methyl-1,4-naphthalene diacetate has anticoagulating properties. 1-acetoxy-2-methylnaphthalene and 1-acetoxy-3-methylnaphthalene are intermediates in the preparation of 2-methylnaphthoquinone-1,4 (vitamin K).

The process of the invention is further illustrated with reference to the following Examples.

EXAMPLE 1

Preparation and examination of some distillable conducting salts

Table 1 below lists some of the results obtained in the distillation of alkanoic acids in the presence of a selection of trialkylammonium acetates or trialkylammonium propionates. The solutions were obtained by adding the amines to carboxylic acid.

TABLE 1

| Amine (g) | | Acid (g) | | Amount used for distillation (g) | Pressure (mm of Hg) | Boiling range (° C) | Distillate (g) | Residue (g) |
|---|---|---|---|---|---|---|---|---|
| $(CH_3)_3N$ | 5.5 | $CH_3COOH$ | 117.0 | 122.5 | 63–67 | 51 – 91 | 120.0 | 0.6 |

TABLE 1-continued

| Amine (g) | | Acid (g) | | Amount used for distillation (g) | Pressure (mm of Hg) | Boiling range (° C) | Distillate (g) | Residue (g) |
|---|---|---|---|---|---|---|---|---|
| $(CH_3)_3N$ | 58.0 | $CH_3COOH$ | 121.0 | 179.0 | 24–13 | 60 – 82 | 160.1 | — |
| $(C_2H_5)_3N$ | 9.0 | $CH_3COOH$ | 117.0 | 126.0 | 60– 7 | 40 – 60 | 123.7 | 1.8 |
| $(n\text{-}C_3H_7)_3N$ | 13.4 | $CH_3COOH$ | 117.0 | 130.4 | 75–43 | 44 – 77 | 126.3 | — |
| $(n\text{-}C_4H_9)_3N$ | 17.3 | $CH_3COOH$ | 117.0 | 134.3 | 84–35 | 52 – 112 | 133.8 | — |
| $(i\text{-}C_4H_9)_3N$ | 17.3 | $CH_3COOH$ | 117.0 | 134.3 | 83–53 | 52 – 108 | 124.4 | — |
| $(CH_3)_3N$ | 5.3 | $CH_3\text{-}CH_2\text{-}COOH$ | 144.4 | 149.7 | 85–65 | 64 – 84 | 149.4 | — |

In all Examples, the conducting salts solutions were recovered during distillation almost quantitatively. No amine losses were found to occur, as tested with reference to the nitrogen balance of the distillation. The conductivities of the solutions used for distillation were the same as those of the distillates within the limits of error.

EXAMPLE 2

Anodic formoxylation of naphthalene

| | | |
|---|---|---|
| Apparatus: | undivided cell, electrode gap: 0.5 mm | |
| Anode: | Pt | |
| Electrolyte: | 200 g | (1.56 moles) of naphthalene |
| | 275 g | of formic acid |
| | 450 g | of acetonitrile |
| | 23 g | of trimethylamine (passed in gaseous form into the HCOOH at room temperature) |
| Cathode: | V2A steel | |
| Q: | 1.0 F/mole of naphthalene | |
| J: | 12.5 A/dm² | |
| T: | 45° C. | |

During electrolysis, the electrolyte is circulated through a heat exchanger.

On completion of electrolysis, the mixture is worked up by separating acetonitrile, formic acid and trimethylammonium formate by distillation at 81° C/760 mm to 92° C/25 mm.

The residue is saponified for one hour at 90° C under a blanket of nitrogen using 10% aqueous caustic soda solution, whereupon the alkaline reaction solution is extracted with ether to separate unreacted naphthalene, the aqueous phase then being acidified with dilute hydrochloric acid and the resulting acid solution extracted with ether. After distilling off the ether and recrystallizing the crude product from aqueous ethanol there is obtained $\alpha$-naphthol in 50% yield (based on naphthalene converted). The current efficiency is thus 37%.

EXAMPLE 3

Anodic acetoxylation of naphthalene a. Use of dimethylammonium acetate as conducting salt

| | | |
|---|---|---|
| Apparatus: | undivided cell, electrode gap: 0.5 mm | |
| Anode: | graphite | |
| Electrolyte: | 1152 g | (9.0 moles) of naphthalene |
| | 600 g | of acetic acid |
| | 1540 g | of acetonitrile |
| | 75 g | of dimethylamine (passed into the $CH_3COOH$ at room temperature) |
| Cathode: | V2A steel | |
| Q: | 1.1 F/mole of naphthalene | |
| J: | 15 A/dm² | |
| T: | 35° C. | |

During electrolysis, the electrolyte was circulated through a heat exchanger.

On completion of electrolysis, the mixture was worked up by distilling off acetonitrile, acetic acid and dimethylacetamide (obtained from dimethylammonium acetate by elimination of $H_2O$) at from 81° C/760 mm to 65° C/30 mm. The residue is then fractionally distilled at from 55° to 175° C/10 mm. There is thus obtained 1-acetoxynaphthalene in 68.5% yield (based on naphthalene converted). The current efficiency is 42.8%.

b. Use of trimethylammonium acetate as conducting salt

| | | |
|---|---|---|
| Apparatus: | undivided cell, electrode gap: 0.5 mm | |
| Anode: | graphite | |
| Electrolyte: | 768 g | (6.0 moles) of naphthalene |
| | 2246 ml | of acetic acid |
| | 90 g | of trimethylamine (passed into the acetic acid at room temperature) |
| Cathode: | graphite | |
| Q: | 1.1 f/mole of naphthalene | |
| J: | 11.5 A/dm² | |
| T: | 50° C. | |

During electrolysis, the electrolyte was pumped through a heat exchanger.

On completion of electrolysis, the mixture was worked up by fractional distillation at from 118° C/760 mm to 175° C/10 mm to give 1-acetoxynaphthalene in 53% yield (based on naphthalene converted), the current efficiency being 38%.

If 5% v/v of water is added to the acetic acid, there is obtained monoacetoxynaphthalene in a yield and current efficiency of the same order of magnitude.

c. Use of trimethylammonium acetate as conducting salt and acetonitrile as cosolvent.

| | | |
|---|---|---|
| Apparatus: | undivided cell, electrode gap: 0.5 mm | |
| Anode: | graphite | |
| Electrolyte: | 384 g | (3.0 moles) of naphthalene |
| | 1146 ml | of acetic acid |
| | 1500 ml | of acetonitrile |
| | 55 g | of trimethylamine (passed into the acetic acid at room temperature) |
| Cathode: | V2A steel | |
| Q: | 1.1 F/mole of naphthalene | |
| J: | 11.5 A/dm² | |
| T: | 40° C. | |

During electrolysis, the electrolyte was circulated through a heat exchanger.

On completion of electrolysis, the mixture was worked up by distillation at from 81° C/760 mm to 175° C/10 mm to give monoacetoxynaphthalene in a yield of 64.8% (based on naphthalene converted) and a current efficiency of 55.5%.

Table 2 below lists the results of some tests carried out at different concentrations of conducting salt (test conditions similar to 3 c).

TABLE 2

| $(CH_3)_3N$ | Yield of monoacetoxynaphthalene | Current efficiency of monoacetoxynaphthalene |
|---|---|---|
| 119 g | 54.2% | 43.0% |
| 55 g | 64.8% | 55.5% |
| 17 g | 50.0% | 42.6% |

Naphthyl acetate may be saponified to naphthol by known methods. This gives α-napththol. The content of β-naphthol in the crude product is not more than from 2 to 3% depending on the test conditions.

EXAMPLE 4

Anodic acetoxylation of 2-methylnaphthalene a. Use of dimethylammonium acetate as conducting salt

| | |
|---|---|
| Apparatus: | undivided cell, electrode gap: 0.5 mm |
| Anode: | graphite |
| Electrolyte: | 426 g (3.0 mole) of 2-methylnaphthalene<br>500 ml of acetonitrile<br>191 ml of acetic acid<br>29 g of dimethylamine (passed into the acetic acid at room temperature) |
| Cathode: | V2A steel |
| Q: | 1.1 F/mole of 2-methylnaphthalene |
| J: | 11.5 A/dm² |
| T: | 25° C. |

During electrolysis, the electrolyte was circulated through a heat exchanger.

Working up was effected by adding 65 g of acetic anhydride and then separating acetonitrile, acetic acid, dimethylacetamide and unreacted 2-methylnaphthalene by distillation at from 81° C/760 mm to 110° C/0.2 mm, and the residue is fractionally distilled (from 110° to 130° C/0.2 mm). There is thus obtained 1-acetoxy-2-methylnaphthalene in a yield of 71% (based on 2-methylnaphthalene converted) and a current efficiency of 65.5%.

When the monoacetoxy-2-methylnaphthalene is saponified by known methods, there is obtained a 2-methylnaphthol mixture in almost quantitative yield, this mixture consisting of 80% of 2-methylnaphthol-1 and 20% of 3-methylnaphthol-1, as determined by gas chromatography.

Table 3 below lists the results of some tests using different concentrations of conducting salt (test conditions similar to 4 a).

TABLE 3

| $(CH_3)_2NH$ | $CH_3COOH$ | Yield of monoacetoxy-2-methylnaphthalene | Current efficiency of monoacetoxy-2-methylnaphthalene |
|---|---|---|---|
| 0.65 mole | 3.3 moles | 71.0% | 65.5% |
| 0.89 mole | 3.3 moles | 67.5% | 60.0% |
| 1.22 mole | 3.3 moles | 60.0% | 47.2% |
| 1.42 mole | 3.3 moles | 58.9% | 36.8% |

b. Use of trimethylammonium acetate as conducting salt

| | |
|---|---|
| Apparatus: | undivided cell, electrode gap: 0.5 mm |
| Anode: | graphite |
| Electrolyte: | 426 g (3.0 moles) of 2-methylnaphthalene<br>382 ml of acetic acid<br>500 ml of acetonitrile<br>78 g of trimethylamine (passed into the acetic acid at room temperature) |
| Cathode: | V2A steel |
| Q: | 1.1 F/mole of 2-methylnaphthalene |
| J: | 11.5 A/dm² |
| T: | 25° C. |

During electrolysis, the electrolyte is pumped through a heat exchanger.

Working up is effected by distilling off acetonitrile, acetic acid and trimethylammonium acetate at from 81° C/760 mm to 90° C/15 mm. The residue is fractionally distilled as described in Example 4 a. There is thus obtained monoacetoxy-2-methylnaphthalene in a yield of 77.4% (based on 2-methylnaphthalene converted). The current efficiency is 53.4%.

Table 4 below lists of the results of some tests using different concentrations of conducting salt (test conditions similar to 4 b).

TABLE 4

| $(CH_3)_3N$ | $CH_3COOH$ | Yield of monoacetoxy-2-methylnaphthalene | Current efficiency of monoacetoxy-2-methylnaphthalene |
|---|---|---|---|
| 0.64 mole | 3.3 moles | 74.7% | 56.2% |
| 1.36 mole | 3.3 moles | 31.6% | 5.4% |
| 1.32 mole | 6.6 moles | 77.4% | 53.4% |

Yields of the same order of magnitude are obtained when use is made of $CH_2Cl_2$, $(CH_3)_2CO$ or dimethoxyethane as cosolvent.

c. Use of triethyl- or tri-n-butyl-ammonium acetate as conducting salt

The test conditions and working up are similar to those described in 4 b, the electrolyte consisting of 426 g of 2-methylnaphthalene, 200 g of acetic acid and 500 ml of acetonitrile. To this mixture, the amounts of amine given in Table 5 below were added.

TABLE 5

| Amine | | Yield | Current efficiency |
|---|---|---|---|
| | | of monoacetoxy-2-methylnaphthalene | |
| $(C_2H_5)_3N$ | 0.65 mole | 66.9% | 61.3% |
| $(n\text{-}C_4H_9)_3N$ | 0.6 mole | 51.0% | 59.4 |

EXAMPLE 5

Anodic acetoxylation of 1-chloronaphthalene

| | | |
|---|---|---|
| Apparatus: | undivided cell, electrode gap: 0.5 mm | |
| Anode: | graphite | |
| Electrolyte: | 487 g | (3.0 moles) of 1-chloronaphthalene |
| | 500 ml | of acetonitrile |
| | 191 ml | of acetic acid |
| | 28 g | of dimethylamine (passed into the acetic acid at room temperature) |
| Cathode: | V2A steel | |
| Q: | 1.1 F/mole of 1-chloronaphthalene | |
| J: | 11.5 A/dm² | |
| T: | 25° C. | |

During electrolysis, the electrolyte is pumped through a heat exchanger.

Working up is effected by adding 63.5 g of acetic anhydride and distilling off acetonitrile, acetic acid and dimethyl acetamide at from 81° C/760 mm to 65° C/30 mm, the residue then being fractionally distilled at from 58° C/10 mm to 145° C/0.5 mm. There is thus obtained 1-acetoxy-4-chloronaphthalene in a yield of 50% (based on 1-chloronaphthalene converted). The current efficiency is 39.3%.

We claim:

1. Electrochemical manufacture of aromatic or heterocyclic esters of the formula

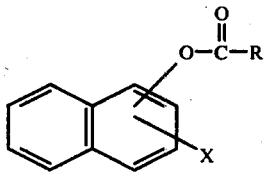

in which X denotes hydrogen, chlorine or methyl and R denotes hydrogen, methyl or ethyl by anodic acyloxylation of compounds of the formula

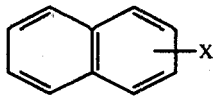

in which X has the meaning stated above, with an alkanoic acid of the formula RCOOH, in which R has the meanings stated above, wherein electrolysis is carried out in the presence of from 1 to 20% by weight of a conducting salt of the formula $$[R^1R^2R^3NH]^+ [OOCR]^-$$

in which R has the meanings stated above and $R^1$, $R^2$ and $R^3$ denote alkyl of 1 to 8 carbon atoms, whereby when X is hydrogen, the acyloxylation of naphthalene occurs in the $\alpha$-position, and whereby said conducting salt is recovered by distillation following the anodic acyloxylation.

2. A process as set forth in claim 1, wherein the conducting salts used are trimethylammonium formate, trimethylammonium acetate, trimethylammonium propionate, triethylammonium formate, triethylammonium acetate or triethylammonium propionate.

3. A process as set forth in claim 1, wherein the aromatic compound used is naphthalene, 2-methylnaphthalene or 1-chloronaphthalene.

4. A process as set forth in claim 1, wherein the alkanoic acid used is formic acid, acetic acid or propionic acid.

* * * * *